United States Patent [19]

Ebihara

[11] Patent Number: 4,778,096

[45] Date of Patent: Oct. 18, 1988

[54] ANVIL FOR A DISPOSABLE STAPLER

[75] Inventor: Yushiyuki Ebihara, Tokyo, Japan

[73] Assignee: Etona Company Limited, Tokyo, Japan

[21] Appl. No.: 868,357

[22] Filed: May 29, 1986

[30] Foreign Application Priority Data

Oct. 15, 1985 [JP] Japan ..... 60-229641

[51] Int. Cl.[4] ..... B25C 7/00

[52] U.S. Cl. ..... 227/155; 227/156

[58] Field of Search ..... 227/120, 155, 156

[56] References Cited

U.S. PATENT DOCUMENTS 4,040,556 8/1977 Dahle ..... 227/120

4,546,909 10/1985 Ebihara ..... 227/120

*Primary Examiner*—E. R. Kazenske

*Assistant Examiner*—James L. Wolfe

*Attorney, Agent, or Firm*—Abelman Frayne Rezac & Schwab

[57] ABSTRACT

An anvil for a disposable stapler is provided by an elongate metal member of undulated transverse cross-section which is an interference fit in a recess formed in a plastic base of the stapler and which is force fit therewithin to position and locate the anvil in the absence of further securing members.

1 Claim, 1 Drawing Sheet

ANVIL FOR A DISPOSABLE STAPLER

BACKGROUND OF THE INVENTION

1. Field of the Invention:

The present invention relates to a stapler and more particularly to an improved anvil used in the stapler.

2. Description of the Prior Art:

There is known a stapler comprising a plastic magazine containing a set of staples, a plastic handle pivotally mounted on the upper portion of the magazine and a plastic base similarly pivotally mounted on the lower portion of the magazine, said handle including a metallic actuating member extending downwardly therefrom at the forward end, said actuating member being arranged such that when it is moved past openings formed through said magazine at its forward end, the forwardmost one of the staples contained in said magazine is driven downwardly out of said magazine to pass through objects to be bound and then engaged and caulked by an anvil on the forward end of said base. Such a stapler requires a tough and rigid anvil which can receive and inwardly caulk the legs of a driven staple toward the staple body. It can easily be thought out that a metallic anvil is rigidly mounted on a plastic base in place. In this connection, various proposals have been made in the art.

For example, the anvil can be formed as a curved and grooved member of a metal material such as spring steel, which member is fitted into a recess formed on the forward end of a base in position. In this arrangement, the recess of the base includes two latching holes formed therein at the opposite sides while the curved and grooved member includes two legs depending from the opposite sides thereof. The latching holes in the base respectively receive the legs of the curved and grooved member to rigidly position the curved and grooved member in the recess of the base. The latching holes are formed through the base at the recess thereof. The through-holes may be replaced simply by recesses if the lower ends of the legs on the curved and grooved member can satisfactorily be received and mounted in such recesses. In any event, the curved and grooved member requires two depending legs. Therefore, corresponding additional expense and material are required to produce the anvil.

SUMMARY OF THE INVENTION

It is therefore an object of the present invention to provide a stapler having an anvil which can easily and simply be produced from less material and which can easily be assembled into the stapler.

In accordance with the present invention, a stapler of the aforementioned type comprises a resilient metal anvil being of an elongated configuration and having a substantially W-shaped cross-section, each of the opposite sides of the W having an engaging portion outwardly turned and extending substantially horizontally therefrom, each of the engaging portions on the anvil being engaged in the corresponding one of recesses formed on the inner opposed walls of the base at the top thereof, whereby the anvil can be held in place at the forward end of the base under a frictional force between the side faces of the engaging portions of the anvil and the inner walls of the recesses.

DESCRIPTION OF PREFERRED EMBODIMENT

The present invention will now be described by way of example with reference to the accompanying drawings.

Figure 2:
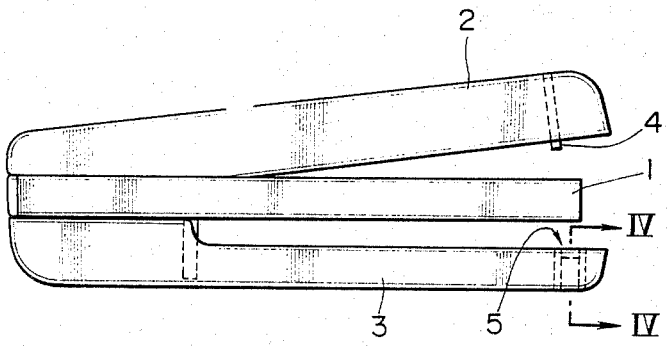
FIG. 2 is a side view of a stapler into which the anvil of the present invention is incorporated.
Figure 3:
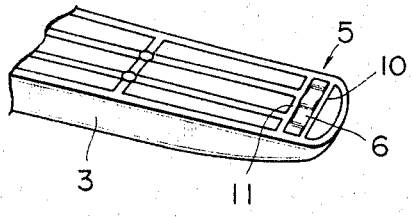
FIG. 3 is a perspective view of the forward end of the base in the stapler of FIG. 2.

Referring now to FIG. 2, there is shown a stapler comprising a magazine 1 containing a set of staples, a handle 2 pivotally mounted on the upper part of the magazine 1 and a base 3 similarly pivotally mounted on the lower part of the magazine 1. This illustrated stapler is a disposable stapler which is substantially entirely made of a plastic material and which has previously been proposed by the inventors. Therefore, only the functions of the stapler is simply described herein. When the handle 2 is manually pivoted downwardly, a metallic actuating member 4 on the forward end thereof is passed through throughopenings in the forward end of the magazine 1 and downwardly drives the forwardmost one of the set of staples charged in the magazine 1. In this connection, it is apparent that a staple is of U-shaped configuration having two legs depending therefrom at the opposite ends. The legs of the driven U-shaped staple pass through objects to be bound until the legs are engaged and caulked by an anvil 5 on the forward end of the base 3.

Figure 1:
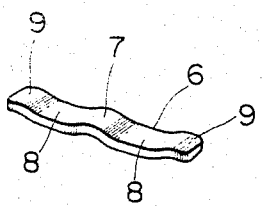
FIG. 1 is a perspective view of a metal piece providing an anvil constructed in accordance with the present invention.
Figure 4:
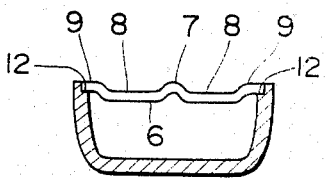
FIG. 4 is a cross-sectional view taken along a line IV—IV in FIG. 2.

As best seen from FIGS. 1 and 4, the anvil 5 of the present invention is in the form of an elongated piece 6 which is made of a resilient metal material and which has a substantially W-shaped cross-section. The metal piece 6 has a central raised portion 7 and curved valleys 8 at the opposite sides of the central raised portion 7. The curved valleys 8 are adapted to initially receive the legs of a driven staple. Each of the sides of the W has an engaging portion 9 outwardly turned and extending substantially horizontally therefrom.

On the other hand, a pair of longitudinally spaced ribs 10 and 11 are formed inside of the base 3 adjacent to the forward end thereof. The spacing between the inner opposed walls of these transverse ribs 10 and 11 is equal to the longitudinal dimension of the metal piece 6. Recesses 12 are also formed on the inner opposed sidewalls of the base 3 at their tops and between the ribs 10 and 11. The transverse dimension or width of the metal piece 6 is slightly larger than the distance between the transversely opposed inner faces of the recesses 12.

On assembling, the metal piece 6 is placed on the forward end of the base 3 between the ribs 10 and 11. The opposite ends of the metal piece 6 are then pressed down with the engaging portions 9 being brought into engagement with the respective recesses 12 under the resilient action of the metal piece itself. Thus, the assembling is completed. The metal anvil piece 6 is firmly held on the forward end of the base 3 by frictional engagement of the engaging portions 9 with the walls of the recesses 12 and particularly frictional engagement of the side faces of the engaging portions 9 with the lateral inner faces of the recesses 12.

The metal piece providing an anvil in accordance with the present invention can easily and simply be formed with the opposite side portions being turned to provide means for firmly holding the metal piece in the recesses of the base. Further, the metal piece can be made of less material and simply and easily be assembled into the base of the stapler.

I claim:

1. An anvil structure for a disposable stapler having a base formed from plastics material, comprising:

spaced opposed sidewalls of said base provided by a recess in said base;

an elongate anvil formed from a resilient metal, said anvil being formed with transverse undulations between opposite axial ends of said anvil to enhance its resilience, said anvil having a length slightly in excess of the distance between said spaced opposed side walls of said base;

said anvil being an interference fit in said recess of said base, and having been pressed-fitted into said recess for said anvil to be resiliently held therein solely by the frictional engagement of said axial ends of said anvil with said spaced opposed side walls of said base.

* * * * *